US008485858B2

(12) United States Patent
Wei

(10) Patent No.: US 8,485,858 B2
(45) Date of Patent: Jul. 16, 2013

(54) TOY GUN HAVING A LASER SIGHT

(76) Inventor: Ho-Sheng Wei, Taipei Hsien (TW)

( * ) Notice: Subject to any disclaimer, the term of this patent is extended or adjusted under 35 U.S.C. 154(b) by 541 days.

(21) Appl. No.: 12/899,880

(22) Filed: Oct. 7, 2010

(65) Prior Publication Data

US 2012/0085015 A1 Apr. 12, 2012

(51) Int. Cl.
*A63H 33/30* (2006.01)

(52) U.S. Cl.
USPC ..... 446/473

(58) Field of Classification Search
USPC ..... 446/175, 401, 405, 473, 485; 434/21, 434/22; 362/110–113; 42/115–117
See application file for complete search history.

(56) References Cited

U.S. PATENT DOCUMENTS 3,114,362 A * 12/1963 Hellman ..... 124/27
4,161,076 A * 7/1979 Snyder ..... 42/115
4,175,353 A * 11/1979 Pickett ..... 446/406
4,365,439 A * 12/1982 Litynski ..... 446/406
4,777,754 A * 10/1988 Reynolds, Jr. ..... 42/117
5,205,266 A * 4/1993 Kilby, Jr. ..... 124/19
5,351,429 A * 10/1994 Ford ..... 42/115
5,515,636 A * 5/1996 McGarry et al. ..... 42/117
5,531,210 A * 7/1996 Meiser et al. ..... 124/66
6,631,580 B2 * 10/2003 Iafrate et al. ..... 42/134
2005/0086847 A1 * 4/2005 Paulkovich ..... 42/114
2006/0265929 A1 * 11/2006 Haney ..... 42/116

* cited by examiner

*Primary Examiner* — Gene Kim
*Assistant Examiner* — Alyssa Hylinski
(74) *Attorney, Agent, or Firm* — Chun-Ming Shih; HDLS IPR Services

(57) ABSTRACT

A toy gun having a laser sight includes a gun body, a laser sight and a trigger assembly. The laser sight is selectively located in a first position or a second position. The laser sight includes a light-emitting element for aiming a beam toward the front of the gun body and an activating element for controlling the ON/OFF state of the light-emitting element. The trigger assembly includes a trigger and a connecting rod driven by the trigger to bias the activating element. When the laser sight is in the first position, the trigger is pressed to drive the connecting rod to move forwards, thereby biasing the activating element to turn on the light-emitting element. When the laser sight is in the second position, the activating element is located farther away from the connecting rod and unable to be biased by the connecting rod, thereby turning off the light-emitting element.

6 Claims, 7 Drawing Sheets

TOY GUN HAVING A LASER SIGHT

BACKGROUND OF THE INVENTION

1. Field of the Invention

The present invention relates to a toy gun, in particular to a toy gun having a laser sight.

2. Description of Prior Art

More and more people like to play toy gun for shooting BB bullets or paint bullets. Some users like to mount a laser sight on front end of the toy gun for helping them aim at a desired target more precisely.

However, in practice, the user has to turn on the laser sight first, and then aims the target. That is to say, the user needs two steps to complete the aiming action and the shooting action separately. If the aiming action and the shooting action can be performed in one step, the toy gun having such a laser sight will become more convenient and practicable.

Therefore, it is an important issue for the present Inventor to solve the above-mentioned problems.

SUMMARY OF THE INVENTION

The present invention is to provide a toy gun having a laser sight, in which the assembly of the laser sight is easy. Further, the laser sight can be simultaneously driven by a trigger in one step and turned on/off easily by the user.

The present invention provides a toy gun having a laser sight, including a gun body having an accommodating trough at its front end, an inner wall of the accommodating trough being provided with a sliding member; a laser sight mounted in the accommodating trough, the laser sight comprising a light-emitting element for emitting a beam toward the front end of the gun body, and an activating element for controlling an ON/OFF state of the light-emitting element, a surface of the laser sight being formed with a first groove and a second groove, the sliding member being selectively engaged in the first groove or the second groove; and a trigger assembly comprising a trigger and a connecting rod driven by the trigger; wherein the trigger is pressed to drive the connecting rod to move forwards when the sliding member is engaged in the first groove, thereby biasing the activating element to turn on the light-emitting element; the activating element is located farther away from the connecting rod and unable to be biased by the connecting rod when the sliding member is engaged in the second groove, thereby turning off the light-emitting element.

In comparison with prior art, the present invention has advantageous features as follows.

According to the present invention, since the laser sight is inserted into the accommodating trough with the rib of the sliding member being engaged with the first groove or the second groove, the user can detach the laser sight from the gun body easily and quickly by pressing the sliding member. Further, owing to the special profile of the laser sight, the user needs not to insert the laser sight into the accommodating trough by visual alignment. Even in a dark place or at night, the user can still correctly insert the laser sight into the accommodating trough by his/her touch feeling.

When the sliding member is engaged in the first groove, the user presses the trigger to activate the light-emitting element to emit a beam toward the front of the gun body. If the user does not press the trigger, the laser sight will not be activated. Thus, the user does not need to worry that the laser sight is not turned on or the electricity of the batteries in the laser sight is almost used up. Further, the user also needs not to turn off the laser sight every time he/she finishes the shooting.

When the sliding member is engaged in the second groove, the laser sight moves toward the front of the gun body by a small distance, so that the activating element is located farther away from the connecting rod and unable to be activated by the connecting rod. Thus, the light-emitting element is turned off. At this second position, even the user presses the trigger, the connecting rod is still unable to bias the activating element to turn on the light-emitting element. Therefore, the user aims the desired target by his/her naked eyes without turning off the laser sight first.

According to the present invention, the laser sight is inserted into the accommodating trough of the gun body, and the degree of inserting the laser sight into the accommodating trough can be changed by engaging the sliding member with the first groove or the second groove. In other words, the user can recognize the working state of the laser sight based on the degree of inserting the laser sight into the accommodating trough. Thus, even in a dark place or at night, the user can insert the laser sight into the accommodating trough rapidly or switch the laser sight to its different operating states. Further, the user can complete the aiming action and the shooting action by one step, thereby increasing the accuracy, mobility and practicability of the toy gun greatly.

DETAILED DESCRIPTION OF THE INVENTION

The detailed description and technical contents of the present invention will become apparent with the following detailed description accompanied with related drawings. It is noteworthy to point out that the drawings is provided for the illustration purpose only, but not intended for limiting the scope of the present invention.

Figure 1:
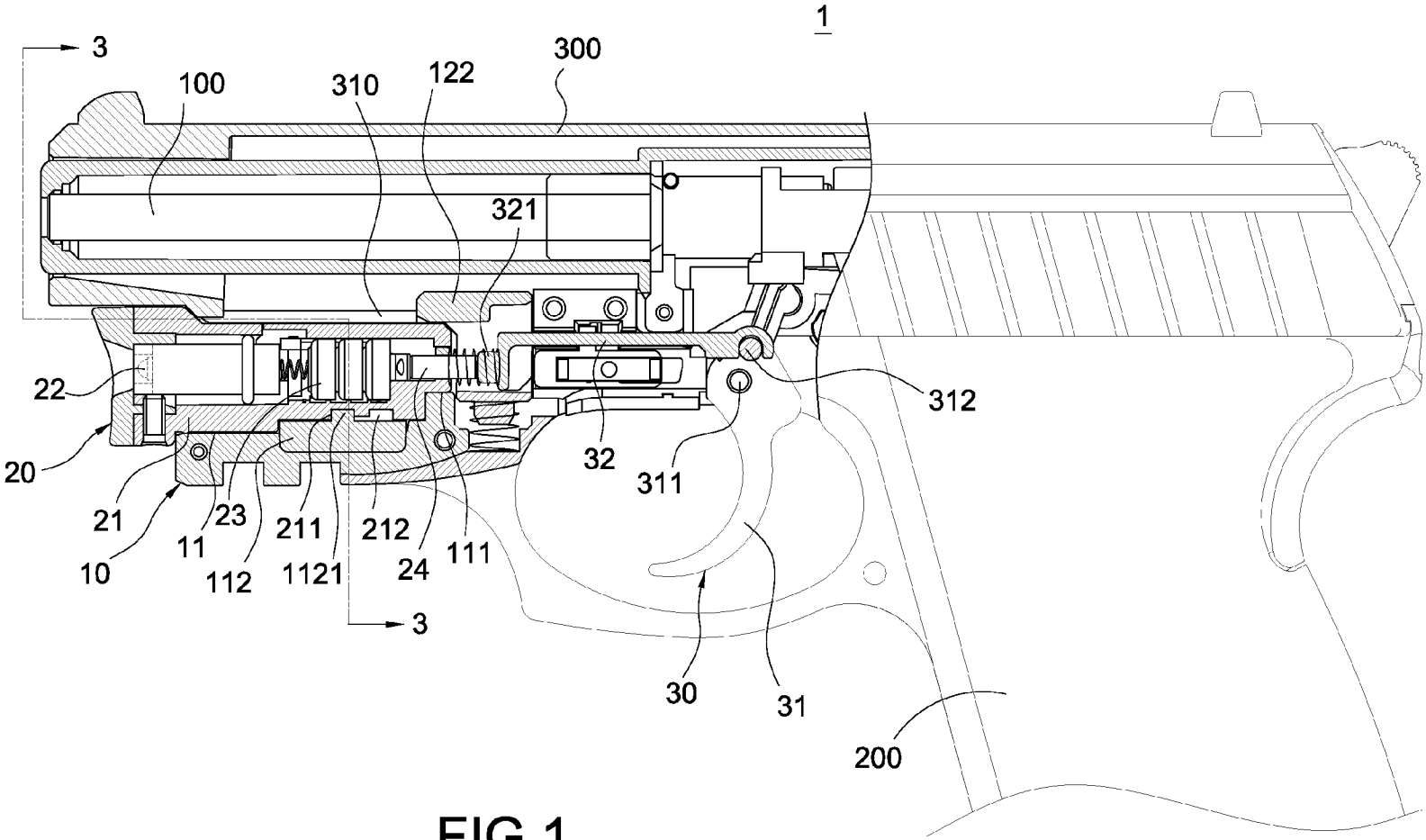
FIG. 1 is a cross-sectional view of the present invention showing a laser sight is located in a first position and a trigger is not pressed yet.

Please refer to FIG. 1. The present invention provides a toy gun having a laser sight (referred to as "toy gun 1" hereinafter), which includes a gun body 10, a laser sight 20 and a trigger assembly 30. As for the rest portions of the toy gun 1, such as a barrel 100, a grip 200, a slider 300 and a shooting mechanism (not shown), these portions are conventional and not the characteristic features of the present invention, so that the description thereof is omitted for simplicity.

First, some directional terms used herein such as "front" and "rear" are described. The directional term "front" is defined as a direction to which the gun mouth is pointing when the user holds the gun with the grip facing toward the ground. As a result, the directional term "rear" is defined as the direction opposite to the front. In this way, the directional terms "upward" and "downward" are defined accordingly.

The front end of the gun body 10 has an accommodating trough 11. More specifically, the accommodating trough 11 is formed in the gun body 10 below the barrel 100 and opens forwards, so that the laser sight 20 can be inserted into the accommodating trough 10 from the front end of the gun body 10. A rear side wall of the accommodating trough 11 is provided with a through-hole 111, and a bottom inner wall of the accommodating trough 11 is provided with a sliding member 112. The upper surface of the sliding member 112 is formed with a rib 1121.

The laser sight 20 comprises a casing 21. The periphery surface of the casing 21 is formed with a first groove 211 and a second groove 212 located rearwardly of the first groove 211. The rib 1121 of the sliding member 112 is selectively engaged in the first groove 211 or the second groove 212.

In the casing 21 of the laser sight 20, a light-emitting element 22 for emitting a beam toward the front end of the gun body 10, a power-supplying element 23 electrically connected to the light-emitting element 22, and an activating element 24 for controlling the ON/OFF of the light-emitting element 22 are accommodated. In the embodiment shown in FIG. 1, the light-emitting element 22 is configured to emit a laser beam or an infrared beam. The power-supplying element 23 has a plurality of batteries (the kind and number of the batteries are not limited thereto). The activating element 24 is a spring switch for controlling the ON/OFF state of the electrical connection between the power-supplying element 23 and the light-emitting element 22. More specifically, when the activating element 24 is biased, the power-supplying element 23 supplies electricity to the light-emitting element 22, so that the light-emitting element 22 can emit a beam for aiming at a desired target. When the activating element 24 is not biased, the electrical connection between the power-supplying element 23 and the light-emitting element 22 is cut off, so that the light-emitting element 22 cannot emit the beam for aiming the desired target.

Figure 2:
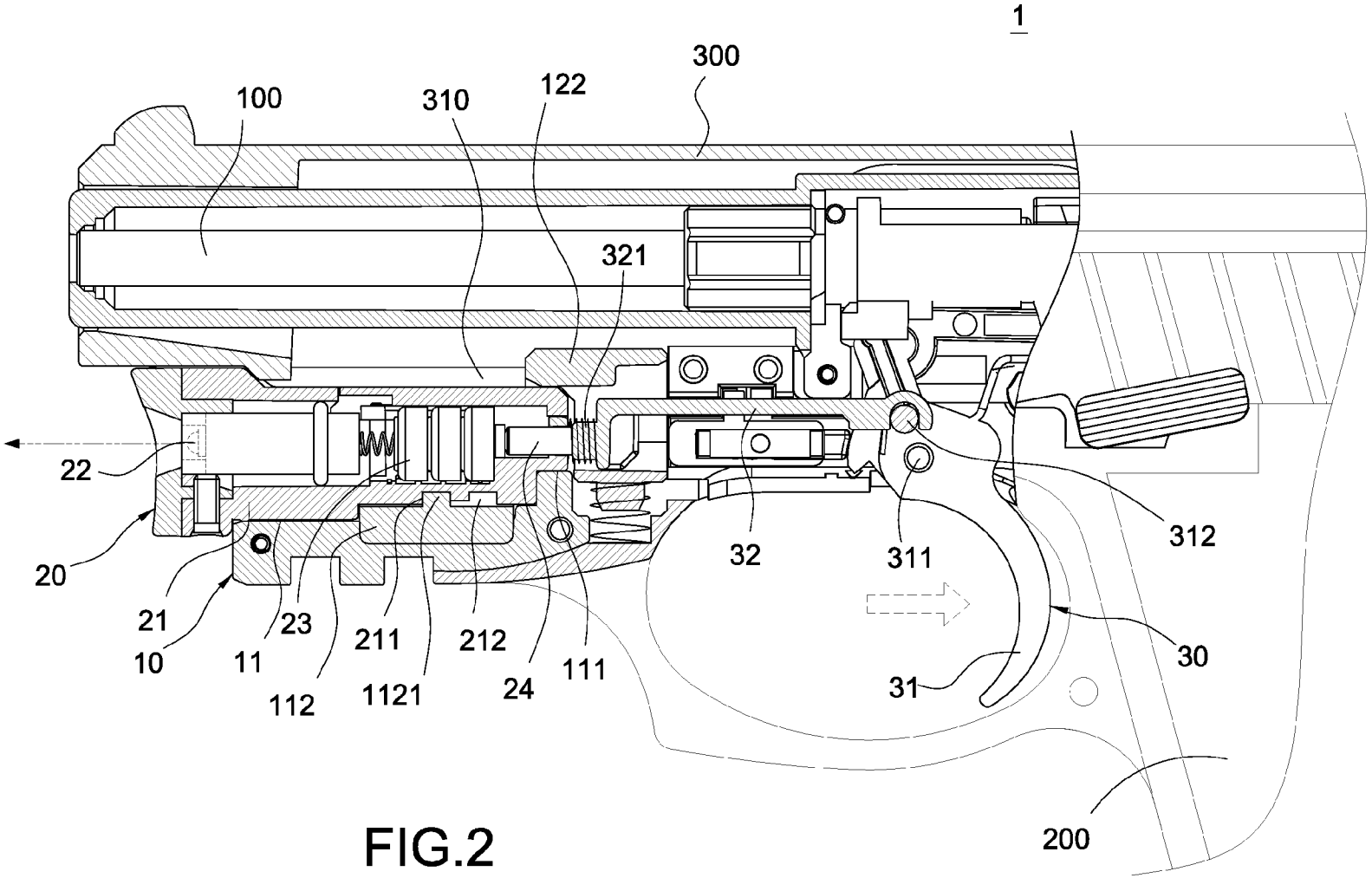
FIG. 2 is a cross-sectional view of the present invention showing the laser sight is located in the first position and the trigger has been pressed.

The trigger assembly 30 is provided between the accommodating trough 11 and the grip 200. The trigger assembly 30 comprises a trigger 31 and a connecting rod 32 driven by the trigger 31. As shown in FIG. 2, the trigger 31 is pivotally connected to the gun body 10 via a pivot 311 and rotatable with regard to the pivot 311. The trigger is formed with a post 312 above the pivot 311. One end of the connecting rod 32 is connected to the post 312, and the other end of the connecting rod 32 is formed with a pushing piece 321. The pushing piece 321 of the connecting rod 32 moves forwards to bias the activating element 24.

Next, the operating principle of the present invention will be described.

Please refer to FIG. 1. When the rib 1121 of the sliding member 112 is engaged in the first groove 211 (referred to as "a first position" hereinafter), in this first position, the laser sight 20 is inserted into the accommodating trough 11 deepest. In the state shown in FIG. 1, since the trigger 31 is not pressed by the user, the activating element 24 has not been biased by the pushing piece 321 to turn on the light-emitting element 22.

Please refer to FIG. 2. When the trigger 31 is pressed by the user, the trigger 31 rotates counterclockwise by using the pivot 311 as a rotation center. As a result, the post 312 located above the pivot 311 moves forwards, which causes the connecting rod 32 to move forwards to bias the activating element 24. In this way, the light-emitting element 22 is activated to emit a beam toward the front end of the gun body 10. When the rib 1121 of the sliding member 112 is engaged with the second groove 212 (referred to as "the second position" hereinafter), the activating element 24 is located farther away from the connecting rod 32 and unable to be biased by the connecting rod 32, thereby turning off the light-emitting element 22.

Figure 4:
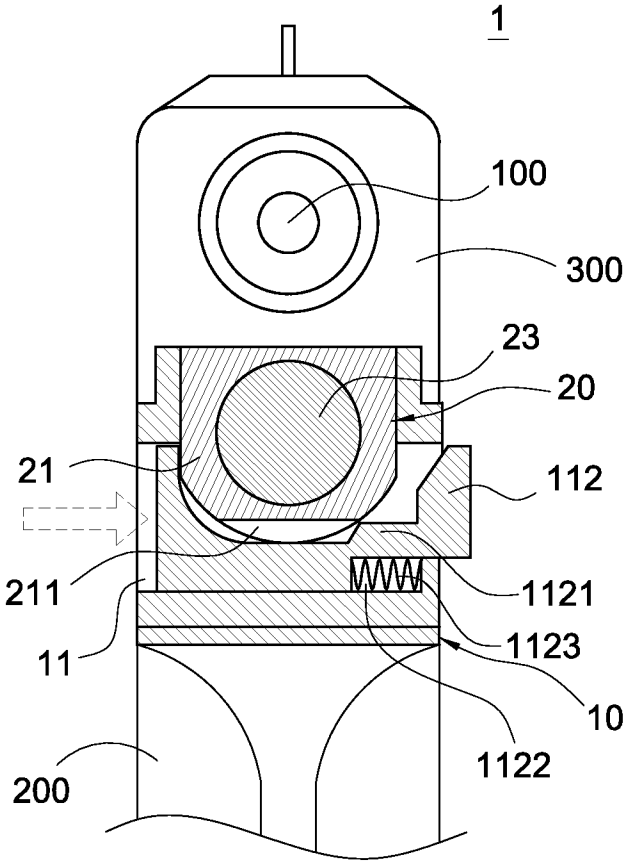
FIG. 4 is another cross-sectional view taken along the line 3-3 in FIG. 1, showing that the sliding member has been pushed rightwards.
Figure 3:
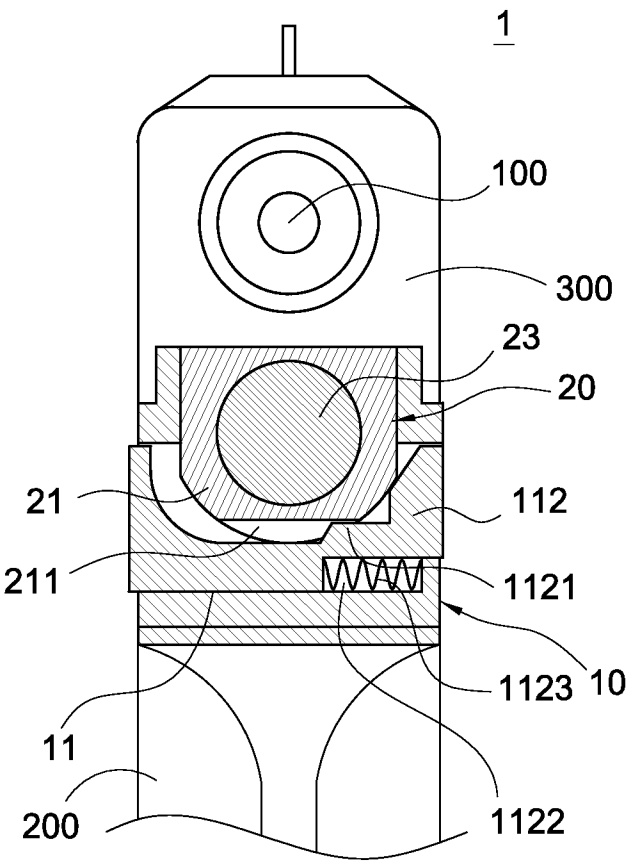
FIG. 3 is a cross-sectional view taken along the line 3-3 in FIG. 1, showing that a sliding member is not pushed.

Please refer to FIGS. 3 and 4, which show the positional relationship of the sliding member 112 relative to the laser sight 20. As seen from a cross section of the barrel 100, the casing 21 of the laser sight 20 is formed into a quadrangle shape with a curved lower edge. Such a profile is fool-proof and helps the user to quickly insert the laser sight 20 into the accommodating trough 11 with the flat upper surface of the casing 10 facing upwards. Therefore, the inner wall of the sliding member 112 located on the inner bottom wall of the accommodating trough 11 is formed with a curved shape to correspond to the outer profile of the lower portion of the casing 21. Since many people often grip the toy gun by their right hand, the sliding member 112 is configured to be slidable from the right side to the left side of the gun body 10. However, since the FIG. 3 is depicted by viewing from the gun mouth, the sliding member is shown in FIG. 3 to be slidable from the left side to the right side. The outer bottom surface of the sliding member 112 is formed with a notch 1122. A spring 1123 is provided between the notch 1122 and the inner bottom wall of the accommodating trough 11, thereby preventing the sliding member 112 from sliding beyond the accommodating trough 11. The sliding member 112 can return to its original position by the elastic force of the spring 1123.

It should be further noted that, as shown in FIG. 3, since the rib 1121 formed on the upper surface of the sliding member 112 is engaged with the first groove 211 of the casing 21, the casing 21 of the laser sight 20 cannot slide any more relative to the sliding member 112. When the user presses the sliding member 112 from the right side of the gun body 10 to make the rib 1121 to be disengaged with the first groove 211, the laser sight 20 can be moved forwards relative to the sliding member 112 until the rib 1121 is engaged with the second groove 212 as shown in FIG. 5 (i.e. "the second position") or the user can detach the laser sight 20 from the accommodating trough 11 completely as shown in FIG. 6.

Figure 5:
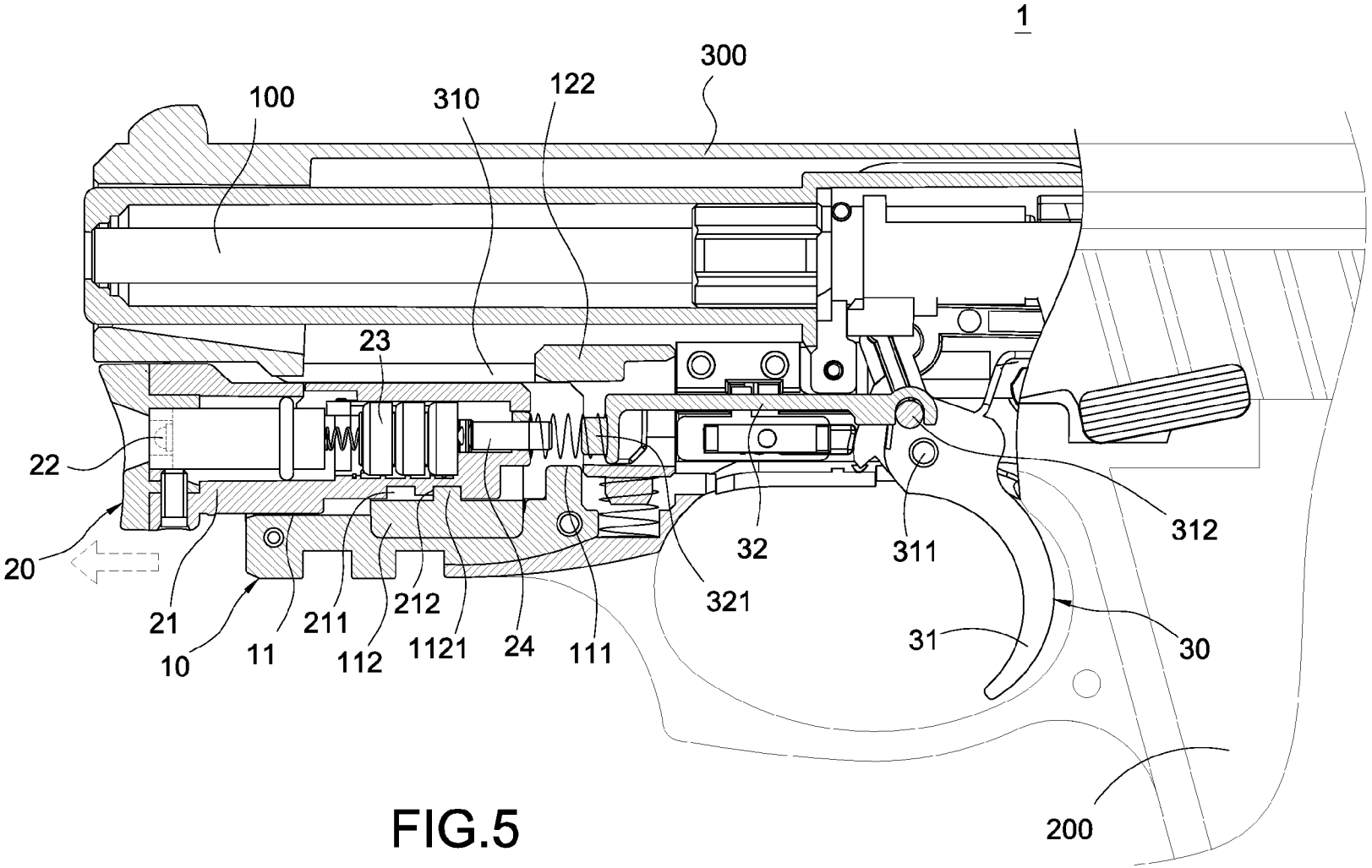
FIG. 5 is a cross-sectional view of the present invention showing the laser sight is located in a second position and the trigger has been pressed.
Figure 6:
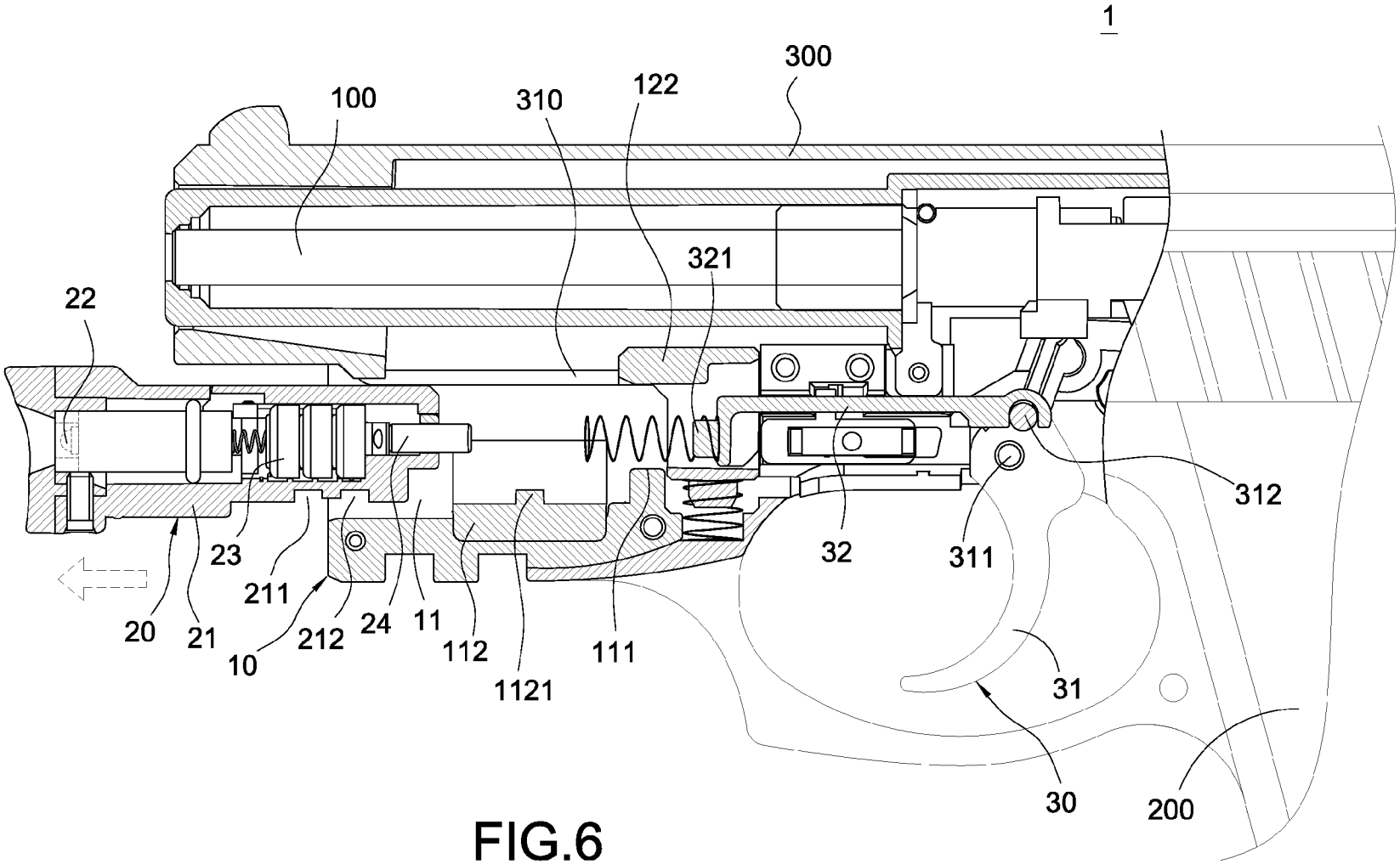
FIG. 6 is a cross-sectional view of the present invention showing the laser sight has been removed from the accommodating trough provided in the front end of the gun body.

Please refer to FIG. 5. When the rib 1121 of the sliding member 112 is engaged in the second groove 212 (i.e., the laser sight 20 is located in the second position), the laser sight 20 is moved forwards by a small distance, so that the activating element 24 is farther away from the pushing piece 321 of the connecting rod 32. Thus, even when the trigger 31 is pressed, the pushing piece 321 of the connecting rod 32 cannot bias the activating element 24 to activate the light-emitting element 22. In other words, when the laser sight 20 is located in the second position, the user can still press the trigger 31 to shoot bullets while the laser sight 20 is inactive. Thus, when the laser sight 20 is not in use, the user needs not to detach the laser sight 20 from the accommodating trough. Instead, the user can move the laser sight 20 forwards by a small distance to thereby turn off the laser sight 20. Since the bottom surface of the casing 21 of the laser sight 20 is provided with the first groove 211 and the second groove 212, the user can recognize in which groove the laser sight 20 is inserted by his/her touch feeling. Therefore, the user can insert the laser sight 20 into the accommodating trough 11 easily and recognize the working states of the laser sight 20 quickly.

Figure 7:
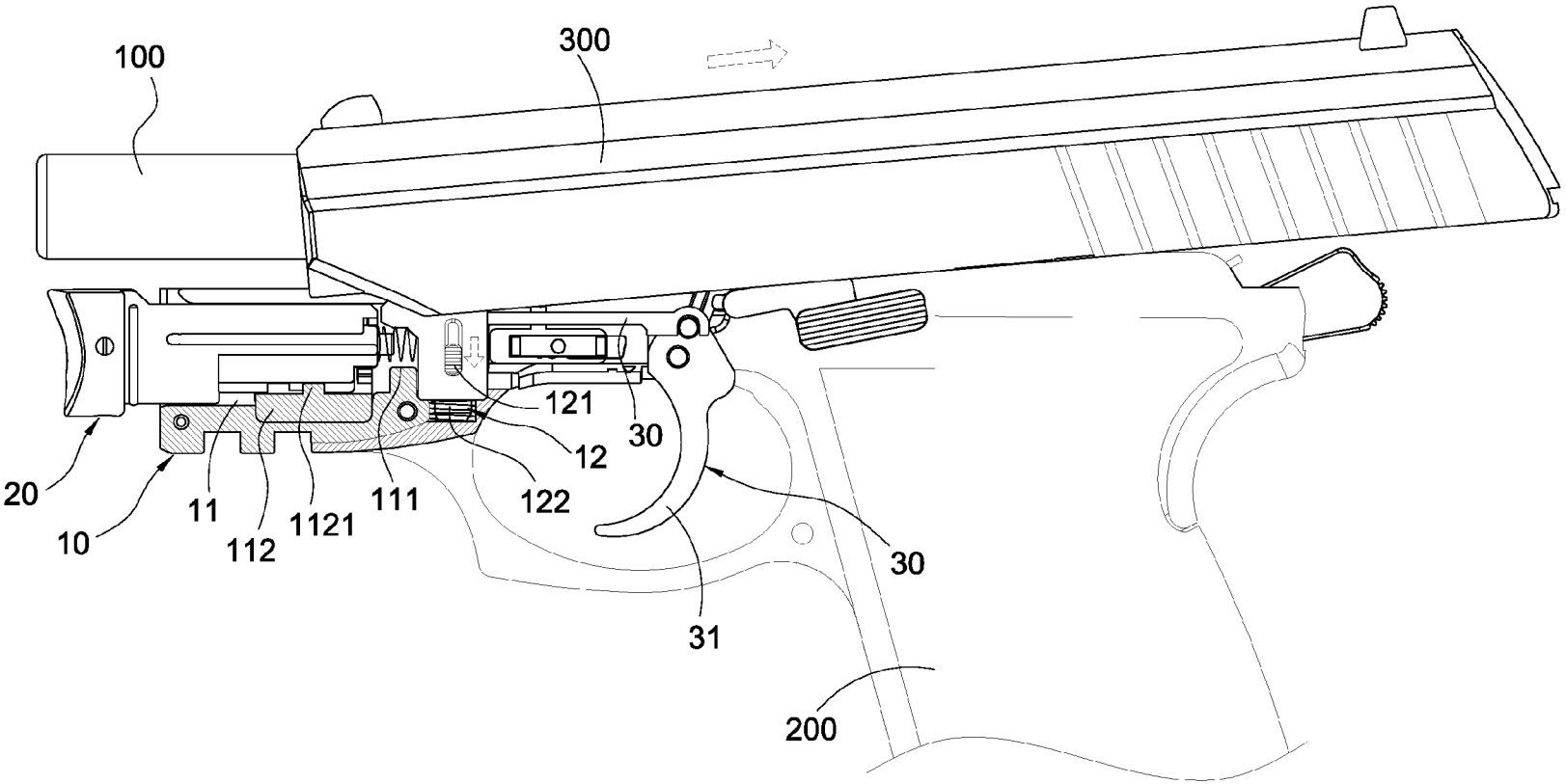
FIG. 7 is a schematic view of the present invention showing that a detachment switch has been pressed to allow the user to detach a slider from the gun body.
Figure 8:
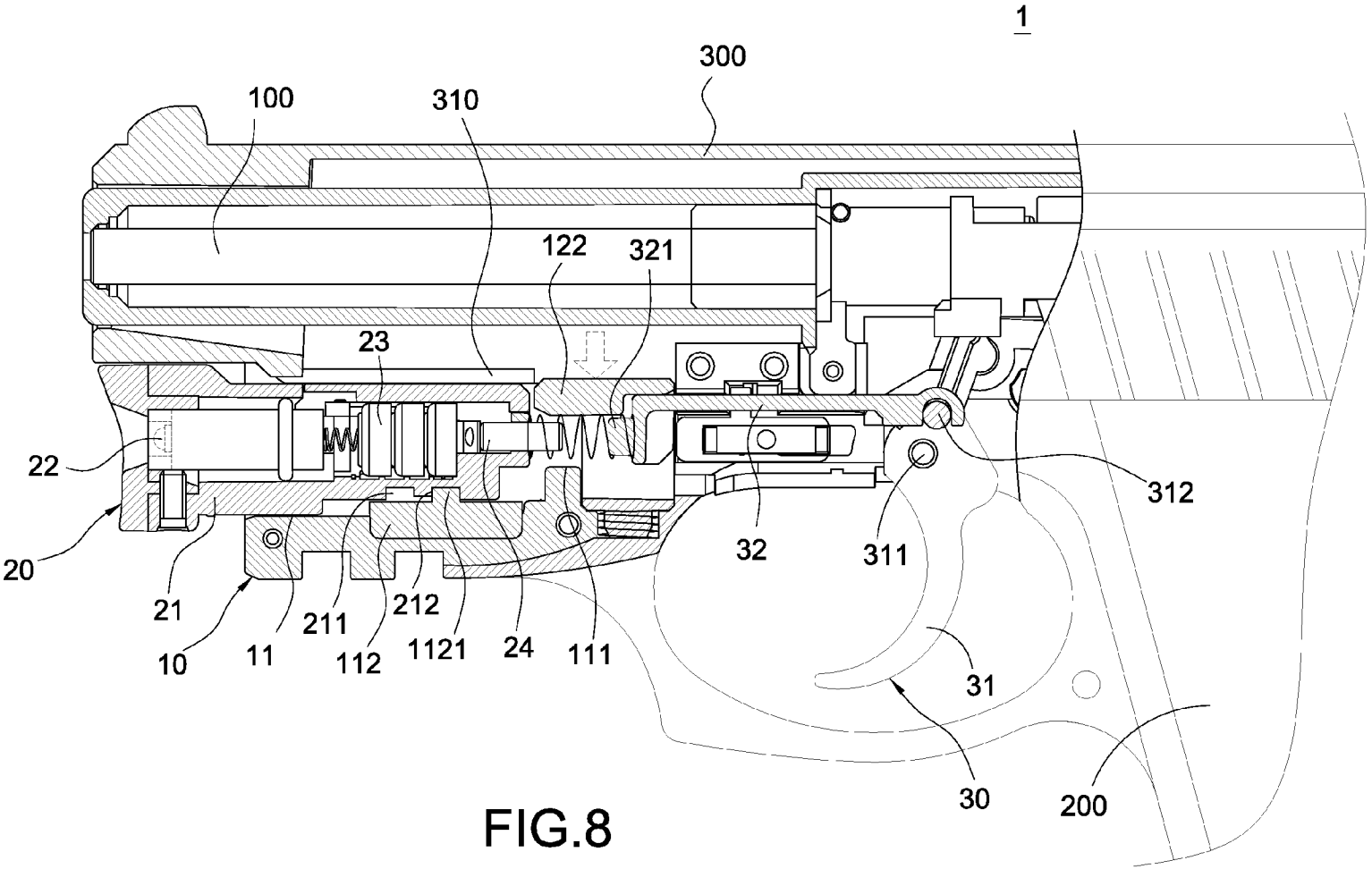
FIG. 8 is a cross-sectional view showing the operating principle of FIG. 7.

With reference to FIGS. 7 and 8, another function of the laser sight 20 of the present invention will be described. As shown in FIG. 7, the left side surface of the gun body 10 is provided with a detachment switch 12. More specifically, the left side surface of the gun body 10 is provided with a hole 13. The detachment switch 12 comprises an operating piece 121 protruding from the hole 13 and a stopping block 122 driven by the operating piece 121. When the laser sight 20 is located in the second position (i.e., the rib 1121 of the sliding member 112 is engaged with the second groove 212), the distance between the rear end of the casing 21 of the laser sight 20 and the connecting rod 32 is larger, the user can make the operating piece 121 to move downwards in the hole 13, thereby causing the stopping block 122 to move downwards to be engaged in the gap between the laser sight 20 and the connecting rod 32. At this time, the lower edge of the slider 300 passes the upside of the stopping block 122 smoothly. Therefore, the slider 300 moves rearwards to achieve the state shown in FIG. 7, so that the user can detach the slider 300 and the shooting mechanism (not shown) from the gun body 1 of the toy gun 1.

With reference to FIG. 2 again, when the laser sight 20 is located in the first position (i.e., the rib 1121 of the sliding member 112 is engaged in the first groove 211 of the laser sight 20), the distance between the rear end of the casing 21 and the connecting rod 32 is smaller, so that the stopping block 122 cannot move downwards to be engaged in the gap between the laser sight 20 and the connecting rod 32. As a result, the user cannot make the operating piece 121 to move downwards in the hole 13. At this time, the lower edge 310 of the slider 300 is stopped by the stopping block 122, so that the slider 300 cannot move rearwards any more. Therefore, the slider 300 cannot be detached from the gun body 10.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A toy gun having a laser sight, including:

a gun body having an accommodating trough at its front end, an inner wall of the accommodating trough being provided with a sliding member;

a laser sight mounted in the accommodating trough, the laser sight comprising a light-emitting element for emitting a beam toward the front of the gun body, and an activating element for controlling an ON/OFF state of the light-emitting element, a surface of the laser sight being formed with a first groove and a second groove, the sliding member being selectively engaged in the first groove or the second groove; and a trigger assembly comprising a trigger and a connecting rod driven by the trigger;

wherein the trigger is pressed to drive the connecting rod to move forwards when the sliding member is engaged in the first groove, thereby biasing the activating element to turn on the light-emitting element; the activating element is located farther away from the connecting rod and unable to be biased by the connecting rod when the sliding member is engaged in the second groove, thereby turning off the light-emitting element.

2. The toy gun having a laser sight according to claim 1, wherein an upper surface of the sliding member is formed with a rib for engaging with the first groove or the second groove.

3. The toy gun having a laser sight according to claim 2, wherein the laser sight comprises a casing, the light-emitting element and the activating element are received in the casing, the first groove and the second groove are formed on a peripheral surface of the casing.

4. The toy gun having a laser sight according to claim 3, wherein the light-emitting element is configured to emit a laser beam or an infrared beam, the power-supplying element has at least one battery, and the activating element is a spring switch.

5. The toy gun having a laser sight according to claim 3, wherein the trigger further comprises a pivot, the trigger is pivotally connected to the gun body via the pivot and rotatable with respect to the pivot, the trigger is formed with a post above the pivot, one end of the connecting rod is connected to the post, the other end of the connecting rod is formed with a pushing piece, and the connecting rod moves forwards to make the pushing piece to bias the activating element.

6. The toy gun having a laser sight according to claim 3, wherein the gun body is provided with a hole and a detachment switch sliding in the hole, the detachment switch is prevented from moving in the hole when the sliding member is engaged in the first groove, and the detachment switch is allowed to move in the hole when the sliding member is engaged in the second groove.

* * * * *